United States Patent [19]

Mastroianni et al.

[11] 4,292,098

[45] Sep. 29, 1981

[54] LIQUID PROPELLANT

[75] Inventors: Joseph E. Mastroianni, La Plata; William F. Newton, Clinton, both of Md.

[73] Assignee: The United States of America as represented by the Secretary of the Navy, Washington, D.C.

[21] Appl. No.: 160,350

[22] Filed: Jun. 17, 1980

[51] Int. Cl.[3] ..... C06B 25/36

[52] U.S. Cl. ..... 149/89; 149/88; 149/92; 149/101; 149/102

[58] Field of Search ..... 149/88, 89, 92, 101, 149/102

[56] References Cited

U.S. PATENT DOCUMENTS 3,783,144 1/1974 Hill et al. ..... 149/88

*Primary Examiner*—Stephen J. Lechert, Jr.

*Attorney, Agent, or Firm*—R. S. Sciascia; A. L. Branning; T. E. McDonnell

[57] ABSTRACT

A liquid monopropellant, suitable as a gun propellant, is obtained from a liquid composition comprising from about 70 to about 95 weight percent of a liquid nitrated organic compound and from about 5 to 30 weight percent of a diester represented by the formula $ROOC(CH_2)_n COOR$ wherein R represents an alkyl of 3 to 5 carbon atoms and n is either 5 or 7.

6 Claims, No Drawings

LIQUID PROPELLANT

BACKGROUND OF THE INVENTION

The invention pertains generally to an energetic gas producing composition and in particular to liquid propellants.

A liquid propellant is one which is introduced into the combustion chamber as a liquid. The term includes all the liquids which may be used in a propellant composition, such as, fuel, oxidizer, catalyst, and other additives. If the fuel and oxidizer are separate compounds, the propellant is termed a bipropellant and if a compound does not require an oxidizer to release its thermal nuclear energy the compound is termed a monopropellant.

An important group of monopropellants consists of nitrated organic compounds, which unfortunately are unstable. These monopropellants have many of the usual liquid propellant advantages, e.g., a greater total impulse, better thrust control and firing determination, longer firing time, and simpler manufacturing. A major disadvantage of these propellants, which severely limits their uses, is their sensitivity.

In order to desensitize these compounds a diluent or a desensitizing agent is usually added to the compound. The most successful liquid propellant to date has been the Otto fuel which was disclosed and claimed in U.S. Pat. No. 4,026,739 issued to Otto Reitlinger. This composition utilizes di-n-butyl sebacate (DBS) as a diluent for 1,2 propylene glycol dinitrate (PGDN) with 2-nitrodiphenylamine as a stabilizing agent. The composition in U.S. Pat. No. 3,634,158 by Albert T. Camp and Paul R. Mosher utilizes metriol trinitrate as an energetic diluent for triethylene glycol dinitrate, included also in the composition is a common storage stabilizer, for instance, ethyl centralite. In U.S. Pat. No. 3,116,188 of Theodore D. Austin, an aliphatic polybasic acid ester, such as, tributyrin $(C_3H_7COO)_3C_3H_5$ or tricaproin $(C_5H_{11}COO)_3C_3H_5$ is used as a desensitizing agent for liquid nitrate esters, such as, nitroglycerin or ethylene glycol dinitrate. The composition, with the lowest sensitivity, utilizes di-n-buty sebacate (DBS) and is disclosed in U.S. Pat. No. 4,026,739. However this composition has the major disadvantage of having an extremely high viscosity at temperature below 0° C. and a glass transition temperature of about −32° C. These disdavantages cause the use of this composition to be restricted to uses at temperatures above 0° C., for example, torpedo propellant.

SUMMARY OF THE INVENTION

It is, therefore, an object of the present invention to render liquid nitrated organic compounds suitable for uses such as gun propellants.

Another object of the present invention is to reduce the sensitivity of liquid nitrated organic compounds.

Another object of the present invention is to lower the freezing temperature of liquid nitrated organic compounds.

Another object of the present invention is to improve the viscosity characteristic below 0° C.

A further object of the present invention is to improve the oxygen balance and combustion characteristics of liquid monopropellants.

A still further object of the present invention is to reduce carbon in the exhaust from liquid monopropellants.

A still further object of the present invention is to reduce the cost of liquid monopropellants.

These and other objects are achieved by mixing a liquid nitrated organic compound with an effective amount of a di-ester of a dibasic acid having 7 or 9 carbon atoms and an alcohol having from 3 to 5 carbon atoms, said di-ester having a vapor pressure less than the nitrated compounds and functioning as a diluent to decrease the sensitivity of the nitrated compound without interferring with the ballistic characteristics of the energetic nitrated compounds.

DETAILED DESCRIPTION OF THE INVENTION

The monopropellant of the present invention utilizes a di-ester having the formula $ROOC(CH_2)_nCOOR$ wherein R represents an alkyl of 3 to 5 carbon atoms and n is 5 or 7 in amount from about 5 to about 25 weight percent of the total composition. The preferred esters are the azelates (n equals 5) with isopropyl or isobutyl ester groups. Preferably the di-esters are compounded in an amount from 5 to 20 weight percent of the total composition. All of these di-esters are easily prepared by standard preparations, e.g. mixing an alcohol with a dibasic acid at room temperature in a 2 to 1 mole ratio.

Examples of liquid nitrated organic compounds are the widely used liquid nitrate esters: propylene glycol dinitrate, triethylene glycol dinitrate, and nitroglycerin and nitroparaffins: nitromethane, nitroethane, or nitropropane. The liquid nitrate esters are preferred because of their lower freezing point which permits a major advantage of the diluents of this invention to be realized. These compounds comprise the remainder of the composition, generally in an amount from about 70 to about 95 weight percent of the total composition.

It is possible to add a stabilizer agent, such as, 2-nitrodiphenylamine, resorcinol, 2-nitro aniline or ethyl centralite. The stabilizer is added in an amount up to about 4 weight percent, usually from about 1 to about 4 weight percent and preferably from 1 to 2 weight percent. The stabilizer is added for the purpose of retarding possible hydrolization of the nitrate esters. Other additives can be included, for example, combustion catalysts, antioxidants, and burning rate modifiers which will not interfere with the effectiveness of the diluent of the present invention.

A monopropellant is easily prepared by mixing together the individual ingredients. The monopropellants, due to their increased stability, are easily stored either in the propellant, in the missile itself, or in ordinary containers. Since these propellants have adequate insensitivity and have a freezing point below −50° C. and a workable viscosity at temperatures as low as about −40° C., these propellants can be readily used as gun propellants such as those used in anti-tank weapons. Other uses include propulsion of surface to air weapons, air launched missiles and air-borne vehicles, e.g. a target drone.

The invention having been described, the following example is given by way of illustration and is not intended to limit the scope of this specification or the claims to follow in any manner.

EXAMPLE 1,2-propyleneglycol dinitrate (PGDN) (76 grams), di-iso-butyl azelate (22.5 grams), and 2-nitrodiphenylamine (1.5 gram) were mixed in a Perkins Mixer for about 15 minutes. Several tests, using standard procedures, were made on this propellant. The decomposition temperature was determined by two methods, the differential thermal analysis and the differential scanning calorimetry methods. The results are summarized in the Table.

TABLE

| Test | Result |
|---|---|
| Water content | 0.05% |
| Freezing Point | −50° C. |
| Specific impulse, calculated | 206 seconds |
| Card gap (solid) | 0 cards |
| Decomposition Temperature (DTA) | 178° C. |
| Decomposition Temperature (DSC) | 195° C. (198° C. OFII) |
| Specific Gravity, P. | 1.2314 22.9° C. |
| [P-1.2596 − .0012537t (t = °C.)] | 1.2579 0.0° C. |
| Viscosity, centipoise | 1.3099 −40.0° C. |
| | 4.69 23.8° C. |
| | 5.46 18.5° C. |
| | 7.36 10.0° C. |
| | 10.89 0.0° C. |
| | 35.29 −21.6° C. |
| | 79.97 −32.0° C. |
| | 225.15 −40.0° C. |
| Viscosity, cps. | 1337.5 −55.0° C. |
| | 5000 −60.0° C. |

The results clearly demonstrate that the monopropellants encompassed by the present invention have a specific impulse, freezing point, sensitivity, and viscosity sufficient to allow the monopropellants to be used effectively as gun propellants. The use of monopropellants, as gun propellants, allows the missiles to be stored more easily and be fired with more reliability.

Also the results clearly demonstrate that the improved low-temperature characteristics of the monopropellant of this invention broaden the application or use potential of liquid nitrate ester monopropellants into areas, such as high-altitude non-air breathing engines and arctic-vehicle-spropulsion systems.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. In a liquid monopropellant composition comprising a nitrate ester or a nitroparaffin, the improvement which comprises the inclusion from about 5 to about 25 weight percent of the total composition of a di-ester having the formula $ROOC(CH_2)_nCOOR$ wherein R is an alkyl of 3 to 5 carbon atoms and n is 5 to 7.

2. The composition of claim 1 wherein n equals 5 and R is selected from the group consisting of isopropyl and isobutyl.

3. The composition of claim 2 wherein said di-ester is present in an amount from 5 to 20 weight percent.

4. The composition of claim 1 which further comprises a stabilizer selected from the group consisting of 2-nitrodiphenylamine, resorcinol, and 2-nitro aniline.

5. The composition of claim 2 which further comprises a stabilizer selected from the class consisting of 2-nitrodiphenylamine, resorcinol, and 2-nitro aniline.

6. The composition of claim 3 which further comprises a stabilizer selected from the class consisting of 2-nitrodiphenylamine, resorcinol, and 2-nitro aniline.

* * * * *